United States Patent [19]

Goto et al.

[11] 3,990,562

[45] Nov. 9, 1976

[54] SERIAL PRINTER

[75] Inventors: Hajime Goto, Komae; Hiroshi Yamakawa, Tokyo; Masayoshi Otuka, Inagi, all of Japan

[73] Assignee: Fujitsu Ltd., Japan

[22] Filed: Aug. 6, 1975

[21] Appl. No.: 602,392

[30] Foreign Application Priority Data

Aug. 13, 1974 Japan ..... 49-92612

[52] U.S. Cl. ..... 197/53; 197/18; 197/49

[51] Int. Cl.[2] ..... B41J 1/40; B41J 1/54

[58] Field of Search ..... 101/93.15–93.18, 101/93.24–93.26; 178/34; 197/16, 18, 48–50, 53–55

[56] References Cited

UNITED STATES PATENTS

| | | | |
|---|---|---|---|
| 1,652,463 | 12/1927 | Tyberg | 197/16 |
| 3,406,807 | 10/1968 | Sasaki et al. | 197/53 X |
| 3,461,996 | 8/1969 | Kapp | 197/55 |
| 3,608,692 | 9/1971 | Henry | 197/55 |
| 3,651,916 | 3/1972 | Becchi | 101/93.17 X |
| 3,695,410 | 10/1972 | Kapp | 197/49 X |
| 3,739,898 | 6/1973 | Rooney | 197/55 |
| 3,827,543 | 8/1974 | Kawano et al. | 197/55 |

*Primary Examiner*—Edgar S. Burr
*Assistant Examiner*—Paul T. Sewell
*Attorney, Agent, or Firm*—Staas & Halsey

[57] ABSTRACT

A serial printer is described which includes a platen, a printer head, a mechanism for selecting one desired type out of a plurality of types on the printer head, a mechanism for joining a printer head shaft and an output shaft of the type selector, a pusher for pushing the selected type further outward than the adjacent types, a support for supporting the printer head and a striking mechanism connected to the printer head for causing the printer head to strike the platen, thereby enabling printing of the desired type. The printer head includes a shaft and a type wheel which is connected to the shaft. The printer head also has a plurality of resiliently supported types thereon. The selector brings a desired type to a printing position on the printer head, and the support allows the printer head to pivotally move about an axis to strike the platen.

22 Claims, 14 Drawing Figures

SERIAL PRINTER

BACKGROUND OF THE INVENTION

The present invention relates to a serial printer.

A number of types must be provided on a printer head of a serial printer. Today, a printer is required to contain at a minimum more than one hundred types and, accordingly, the printer head of the printer becomes large, which results in various disadvantages. A printer head is required to perform a spacing action, a back spacing action, a carriage return action, a tabulating action, a type selecting action and a printing action. The time for all of these actions, especially for the type selecting and the printing actions, depends mainly upon the weight of the printer head. Therefore a large, heavy printer head causes an increase in the time required to perform these actions, which results in a decrease in the printing speed. In addition a large printer head, requires that the printer on which it is installed also be large and a large space is required for a large printer.

SUMMARY OF THE INVENTION

According to the present invention, there is provided a serial printer in which the above disadvantages are obviated or mitigated.

One of the objects of the present invention is to provide a serial printer comprising a small and light weight printer head notwithstanding the fact that it includes many types.

Another object is to provide a serial printer comprising a means for selecting a desired type easily.

A further object is to provide a serial printer comprising a means for pushing the selected type outwardly toward a platen so that the selected type projects further outward than the adjacent types, thereby avoiding side-printing, i.e. needless printing with the types adjacent to the desired one.

A still further object is to provide a serial printer in which a shaft of the printer head and an output shaft of a DC servo motor of said type selecting means are connected coaxially, said DC servo motor rotating the printer head for selecting the desired type. The advantage of connecting the two shafts coaxially is that the rotation of the motor is transmitted directly to the shaft of the printer head so that the operation of selecting a desired type is effected accurately.

A still further object is to provide a serial printer in which a flexible coupling connects the above mentioned two shafts so that the printer head can swing or move pivotally between the printing position and the standing position while the DC servo motor is stationary.

A still further object is to provide a serial printer comprising a means for supporting a printer head which allows the printer head to swing or move pivotally about an axis located on a tangential line which contacts the printing point on a cylindrical platen section. Such an arrangement has the advantage that the type on the printer head always strikes the paper on the platen at a right angle and, thus, the letter is fully printed without light or shaded areas.

According to the present invention there is provided a serial printer comprising:

a platen;

a printer head which includes a shaft and a type wheel which is connected to said shaft and has a plurality of resiliently supported types thereon;

a means for selecting one desired type out of a plurality of types on said type wheel and for bringing said desired type to a printing position on the printer head;

a means for joining the type wheel shaft and an output shaft of the said type selecting means;

a means for pushing the selected type further outward, toward the platen, than the adjacent types;

a means for supporting the printer head and for allowing said printer head to pivotally move about an axis to strike the platen, and;

a striking means connected to the printer head for causing said printer head to strike the platen thereby enabling printing of the desired type.

Embodiments of the present invention will now be described, by way of example, with reference to the accompanying drawings, in which:

DESCRIPTION OF THE PREFERRED EMBODIMENT

Figure 1:
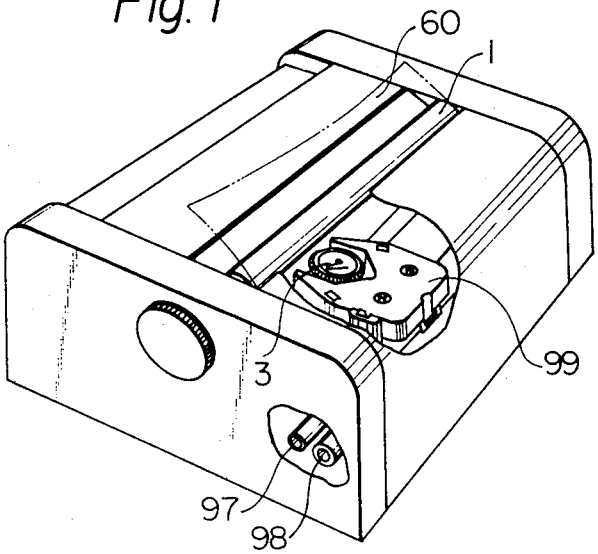
FIG. 1 is a schematic illustration of a serial printer according to the present invention.

Throughout all of the above drawings like reference characters designate like or corresponding parts.

In FIG. 1, a sheet of paper 60 is shown set on a platen 1, a type wheel 3, ribbon cartridge 99, a support member 98, and a drive member 97. The type wheel 3 and the ribbon cartridge 99 are mounted on a carriage which is supported by the support member 98 and is driven to move along the platen 1 by the known mechanism through the drive member 97.

Figure 2:
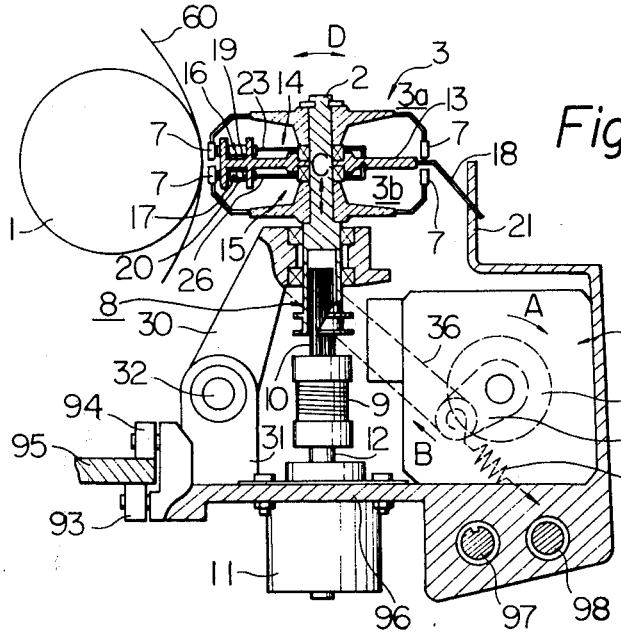
FIG. 2 is a sectional view partly in section of the printer in FIG. 1.

In FIG. 2 a platen 1 is shown which is cylindrical and rotatably fixed to unillustrated side plates of a serial printer according to the present invention. The platen 1 is not limited to a cylindrical construction and may be in the form of a flat plate or the like. Over the platen 1 is set a paper 60. A printer head comprises a shaft 2 and a type wheel 3. The type wheel 3 includes a pair of type wheel elements 3*a* and 3*b*, both of which have substantially the same construction.

Figure 3:
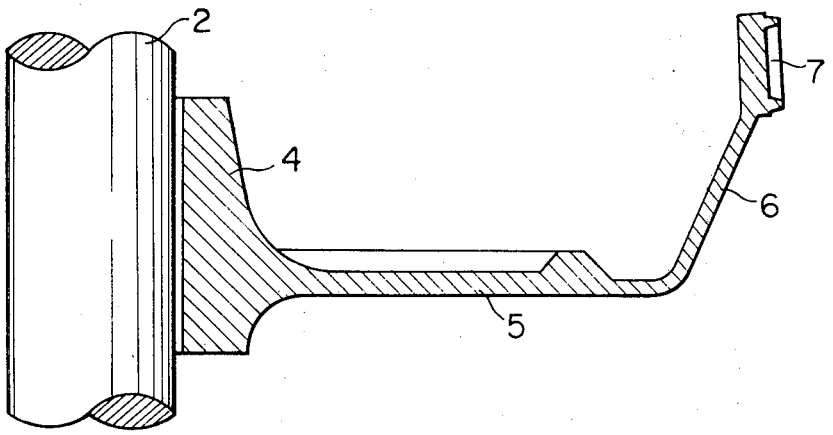
FIG. 3 is an enlarged partial sectional view of a type wheel element according to the present invention.

In FIG. 3, an enlarged partial view of the type wheel element is depicted. Each type wheel element comprises a boss 4, a disc base 5 spreading radially from said boss 4, a number of arms 6 fixed to said disk base 5, and types 7, one of which is molded on the outside of the end of each arm. Accordingly, the types are arranged so as to face outwardly in a circle about the printer head shaft 2. As the arm 6 is resilient, the type 7 can surge or move while the joint between the disk base 5 and the arm 6 is stationary.

In this embodiment of the invention each type wheel element has 64 arms and, thus, the type wheel has 128 arms in all. This means that 128 types can be held on the type wheel because each arm has one type on its end. As the arm 6 bends near the disk base 5 and extends substantially parallel to the shaft 2 instead of spreading straight, the distance between individual types is minimized and, thus, the type wheel 3 is kept small in spite of having so many types. The boss 4, the disk base 5, the arms 6, and the types 7 of the type wheel element are normally molded integrally with thermal plastic material and the type surface is coated with known metallic materials such as, nickel, or chrome, undercoated with copper. The arm 6 and a part of disk base 5 may also be formed with resilient metallic material while only the boss 4 and the type 7 are molded with thermal plastic material.

Although essentially only one type wheel element is needed for a type wheel, in such a case more than 2 types must be arranged on one arm in order to increase the number of types in all. Such an arrangement induces sideprinting, so that it is preferable to arrange two type wheel elements in such a manner that one element covers the other which is upside down, as shown in FIG. 2, in order to avoid sideprinting.

As shown in FIG. 2, the shaft 2 and an output shaft 12 of a DC servo motor 11 are connected by a serration mechanism 8 and a joint 9 having an intermediate flexible resilient member and two joint ends on the opposite ends of said member. One of said joint end is connected to a serrated shaft 10 of said serration mechanism and the other joint end is connected to the output shaft 12. The shaft 2 is hollow at its lower part and is serrated inside in order to engage with the serrated shaft 10. The lower end of the serrated shaft 10 is connected to the flexible joint 9. The flexible joint 9 may be formed with a tightly wound coil spring, with one end of the spring being connected to the serrated shaft 10 and the other end to the outer shaft 12 of the DC servo motor 11. The serrated shaft 10 allows the shaft 2 to slide or move up and down along the shaft 10 as indicated by a double headed arrow C, but prevents relative rotation between the shaft 2 and the shaft 10 so that the rotation of the servo motor shaft is steadily transmitted to the shaft 2. The flexible joint 9 allows the movement or swinging of the shaft 2 as indicated by a double headed arrow D.

Referring again to FIG. 2, the servo motor 11 rotates the type wheel 3 until a desired type faces the paper 60 on the platen 1. The servo motor 11 is mounted under a carriage 96 which is supported by a support member 98 and a support plate 95 which is fixed to the unillustrated printer body. The carriage 96 has rollers 93 and 94, between which the support plate 95 is arranged.

The support member 98 and the support plate 95 extend parallel to the platen 1.

Figure 4:
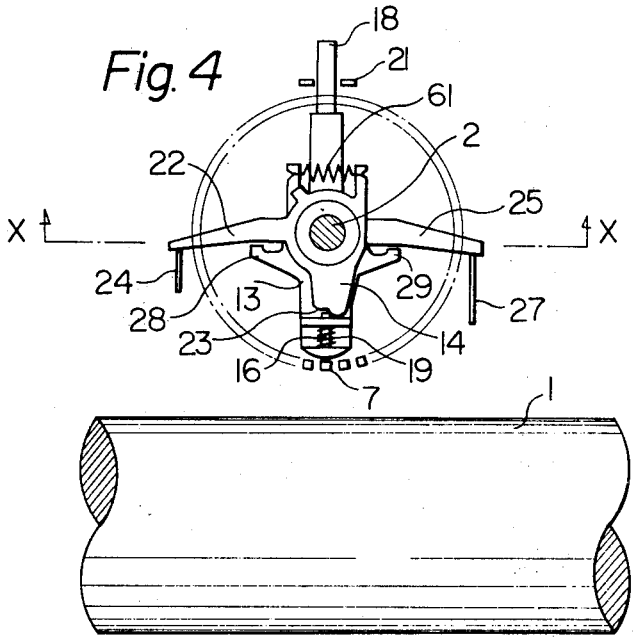
FIG. 4 is a plan view of a means for pushing the type outwardly.
Figure 8:
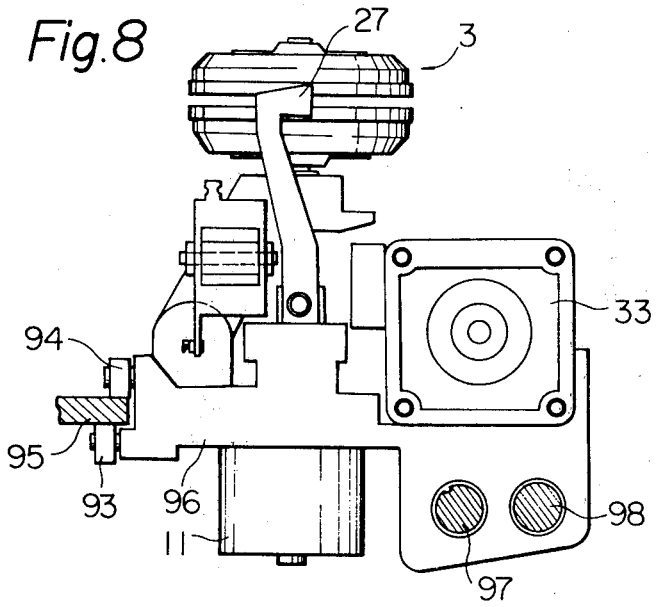
FIG. 8 shows a stopper fixed to a carriage, the stopper corresponding to that depicted in FIG. 5.
Figure 10:
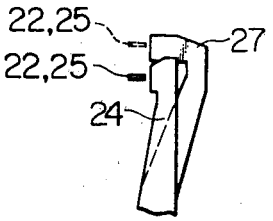
FIG. 10 is an overlapped illustration of the two stoppers which correspond to those illustrated in FIG. 4 as designated by the reference numerals 24 and 27, respectively, showing the difference in height between them.
Figure 14:
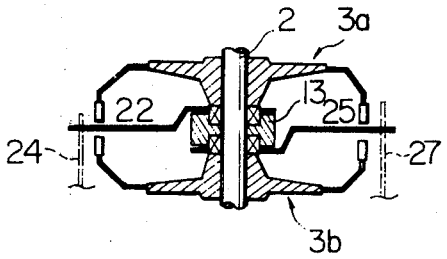
FIG. 14 is a cross sectional view take on line X—X of FIG. 4.

In FIG. 2, a type pushing means is also seen comprising a base member 13, an upper lever plate 14, a lower lever plate 15, an upper pusher 16, a lower pusher 17, and springs 19 and 20. The type pushing means is set in the space between the two type wheel elements 3*a* and 3*b* as shown in FIG. 2. A plan view of this type pushing means is shown in FIG. 4. The upper lever plate 14 comprises a lever 22 and a cam 23. The hidden lower lever plate 15 comprises a lever 25 and a cam 26, respectively corresponding to the lever 22 and the cam 23 of the upper lever plate 14. The two levers 22 and 25 extend out of the type wheel through a slit between the two type wheel elements 3*a*, 3*b*, and are capable of contacting stoppers 24 and 27, respectively, as shown in FIG. 14. The stopper 27 is fixed to the carriage 96 as shown in FIG. 8, and the stopper 24 is also fixed to the carriage 96, in the same manner as the stopper 27 at the opposite side of the type wheel 3. The configurations of the stoppers 24, 27 are shown in FIG. 10 but they are not limited to the illustrations.

Referring again to FIG. 2, a guide lever 18 is fixed to the base member 13 and arranged to pass through an opening of a guide member 21 which is unmovably fixed to the carriage 96. In this way, the base member is prevented from rotating about the shaft 2 while the shaft 2 and the type wheel 3 are rotating and, thus, the upper pusher 16 and the lower pusher 17 always face at right angles to the platen 1. The two pushers 16 and 17 can slidably move toward and away from the platen 1 guided by the base member 13. Normally, the two springs 19 and 20 force the pushers 16 and 17 away from the type 7.

Referring to FIG. 4, a spring 61 connects the two lever plates 14 and 15 (not shown in FIG. 4) to each other and forces them to about against stoppers 28 and 29, respectively, with the result that the recesses of cams 23 and 26 (not shown in FIG. 4) normally contact the two pushers 16 and 17 (not shown in FIG. 4), respectively. The said stoppers 28 and 29 are fixed to the base member 13.

A roller may be arranged instead of the above mentioned cam mechanism with a pusher. In such case, the roller is always in pushing contact with a type on the type wheel element.

Figure 5:
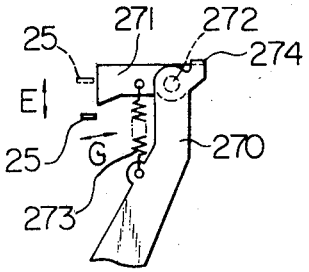
FIG. 5 is a side view of a stopper corresponding to a stopper which is designated by the reference numeral 27 in FIG. 4.
Figure 6:
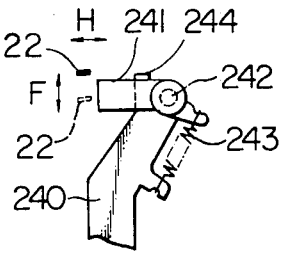
FIG. 6 is a side view of another stopper corresponding to a stopper which is designated by the reference numeral 24 in FIG. 4.

Other embodiments of the stoppers 24 and 27 are depicted in FIGS. 5 and 6.

In FIG. 5, a side view of the stopper 270, corresponding to the stopper 27, is illustrated. The stopper 270 is fixed to the carriage 97 (not shown in FIG. 5), in the same manner as the stopper 27, and has an abutment 271 at its end. The abutment 271 can rotate clockwise (in FIG. 5) about an axis 272, but normally a spring 273 forces it to abut against a stopper 274 as shown in FIG. 5.

In FIG. 6 a side view of the stopper 240, corresponding to the stopper 24, is depicted. The stopper 240 is fixed to the carriage 96 (not shown in FIG. 6), in the same manner as the stopper 24, and has an abutment 241 at its end. The abutment 241 can rotate counterclockwise (in FIG. 6) about an axis 242, but normally a spring 243 forces it to abut against a stopper 244 as shown in FIG. 6.

The operation of the stoppers 270 and 240 will now be described with reference to FIGS. 5 and 6.

In the case of using the stoppers 27 and 24, overlapping of the shifting action of the type wheel and the printing action (both will be described later) must be avoided in order to prevent the catching of the lever 22 or 25 on the top of the stopper 24 or 27. However, by using the stoppers 270 and 240, the above drawback can be obviated. In the shifting action, the levers 22 and 25 move vertically as indicated by double headed arrows 3 and F, and in the printing action they move transversely with respect to the platen (not shown) as indicated by double headed arrows G and H.

In the case where a character on the upper type wheel element is to be printed after the printing of a character on the lower type wheel element, the type wheel moves from the upper position ("shift-out" position) to the lower positon ("shift-in" position). In this case, the lever 22, depicted by solid lines in FIG. 6, at first moves to the right in FIG. 6, and during this operation the other lever 25, located at a position depicted by dotted lines in FIG. 5, is kept abutting against the abutment 271, and the type on the lower type wheel element is printed. Then, the lever 22 moves downward. The downward movement of the lever 22 can be started before it returns to its original position because even if the abutment 241 catches the lever 22, it doesn't prevent the downward movement of the lever 22 since the abutment 241 is rotatable about the axis 242.

Figure 7:
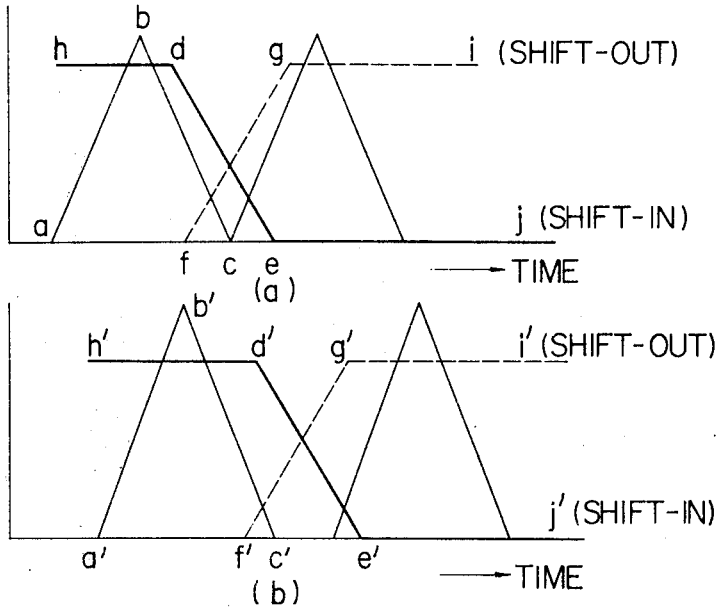
FIG. 7 is composed of graphs representing the relation between printing actions and axial shifting actions of the printer head.

FIG. 7*a* is a chart wherein the above described relation between the time and the movement of the type wheel is represented. In this chart the solid line *hdej* represents the downward movement of the type wheel and the solid line *abc* represents the transverse movement with respect to the platen toward and away from the platen of the type wheel. The downward movement starts at the point *d* and ends at the point *e*. The point *d* is located just after the starting point *b* of the returning movement of the type wheel.

FIG. 7*b* is a chart showing the same type of relation as the chart of FIG. 7*a*, but in this case the stoppers 24 and 27 are used instead of 240 and 270. As shown in FIG. 7*b*, the time of the starting point *d'* of the downward movement is located near the ending point *c'* of the returning movement of the type wheel.

In the case of upward movement of the type wheel, refering to FIG. 5, firstly the lever 25 moves rightwards in FIG. 5, then returns to the original position and, in the course of this returning movement, the lever 25 starts to move upwardly because the rotatable abutment 271 doesn't prevent the lever 25 from moving upwardly. This upward movement is represented by a broken line *fg* in FIG. 7*a*.

Due to the above described actions the vertical shifting action and the printing action can be overlapped with the result that the time between printing actions can be shortened.

Also illustrated in FIG. 2 is a support means which supports the printer head, comprising a link 30 and an upright 31. The link 30 is connected to the shaft 2 at one of its ends and is rotatably connected to the upright 31 at its other end. The shaft 2 can slide axially, though held by the link 30, as indicated by the double headed arrow C. Also, the link 30 can rotate about an axis 32 of the upright 31, and thereby the type wheel 3 swings or moves as indicated by the double headed arrow D.

In FIG. 2, a striking means is also depicted which comprises, a rotatable electromagnet 33 mounted on the carriage 96, an output lever 35 fixed to an output shaft 34 of the electromagnet 33, and a link 36 one end of which is connected to the lever 35 and the other end of which is connected to the aforementioned link 30. When the electro-magnet 33 is excited, the shaft 34 and the lever 35 rotate clockwise as shown by an arrow A in FIG. 2 and, accordingly, the link 36 which is rotatably connected to said lever 35 moves as shown by an arrow B. Thus, the link 36 forces the shaft 2 to rotate about the axis 32 with the result that the type wheel 3 moves toward the platen 1. When the electro-magnet 33 is turned off the shaft 2 is returned by the resiliency of the flexible joint 9 and by a spring 37.

Figure 9:
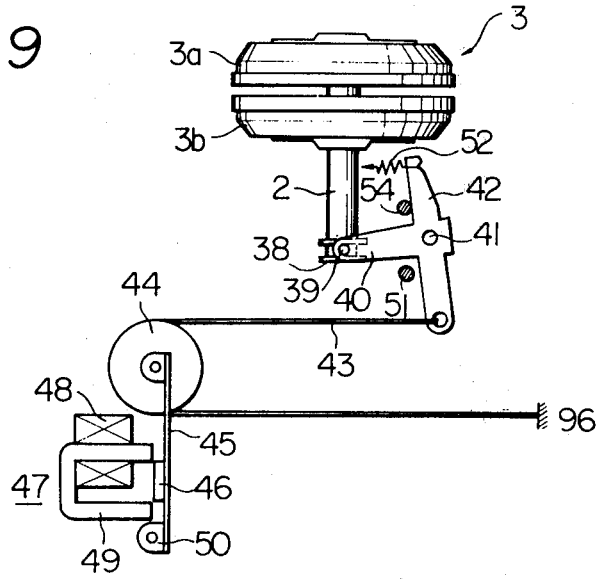
FIG. 9 shows the mechanism of an axial shifting action of the printer head.

In FIG. 9 the shifting mechanism is shown by which the type wheel 3 moves up and down in order to select one element out of the two type wheel elements of 3*a* and 3*b*. As shown in FIG. 9 the shaft 2 has an abutment 38 with which a pin 39 is always in contact. The pin 39 is fixed to a link 40 which is integrally formed with a shifting lever 42 which is rotatable about an axis 41. At one end of this shifting lever 42 is fixed a filament 43, the other end of said filament being fixed to the carriage 96. A pulley 44 cooperates with the filament 43. The pulley 44 is rotatably mounted on a lever 45 to which an armature 46 is fixed. When a solenoid 48 of an electro-magnet 47 is excited, the armature 46 moves toward the magnet and the lever 45 rotates about an axis 50 counterclockwise (in FIG. 9), making the shifting lever 42 rotate clockwise about the axis 41 due to the movement of the pulley 44 and the filament 43. Accordingly, the link 40 of the shifting lever 42 rotates clockwise about the axis 41 with the result that the pin 39 forces the shaft 2 to move upward. Thus, the two wheel elements 3a, 3b and the type pushing means which are fixed to the shaft 2 also move upward until the lever 42 abuts against a stopper 51. This condition wherein the type wheel is raised is called "shift-out".

When the electro-magnet 47 is turned off, a spring 52 forces the shifting lever 42 and the link 40 to turn counterclockwise (in FIG. 9) on the axis 41 until the lever 42 abuts against a stopper 54. Thus, the pin 39 fixed to the end of the link 40 forces the shaft 2 to move downward. Accordingly, the two type wheel elements 3*a*, 3*b* and the type pushing means which are fixed to the shaft 2 also move downward. This condition wherein the type wheel 3 is in the lower position is called "shift-in".

The relation between the shifting action and the operation of the type pushing means will now be described.

Figure 11:
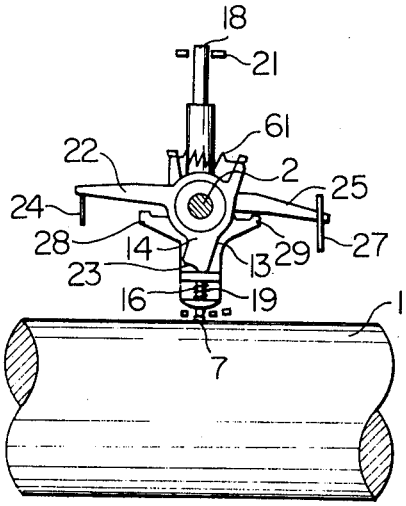
FIG. 11 is a plan view of means for pushing the type outwardly, showing that a desired type is projected.

Referring to FIG. 4 and FIG. 10, when the type wheel is in the shift-out condition, the upper lever 22 and the lower lever 25 of the pushing means are located at the position depicted by the dotted line in FIG. 10. In this case the lower lever 25 abuts against the stopper 27 and, then, rotates about the shaft 2 as the shaft 2 is moved toward the platen 1 by the aforementioned operation of the rotatable magnet 33, while the upper lever 22 is over the stopper 24. On the other hand, when the type wheel is in the "shift-in" condition the levers 22 and 25 of the pushing means are located at the position depicted by the solid line in FIG. 10. In this case the upper lever 22 abuts against the stopper 24 and, then, rotates about the shaft 2 as the shaft 2 is moved toward the platen 1 by the operation of the rotatable electro-magnet 33, while the lower lever 25 is in the recess of the stopper 27. This condition is shown in FIG. 11.

The operation of the serial printer according to the present invention will now be described in detail.

The whole operation is completed by the type selecting action and printing action. The type selecting action is accomplished by the aforementioned shifting action and the action of type character selection in which one desired type is selected out of the many types on the selected type wheel element. The latter action is completed by rotation of the type wheel by the DC servo motor, which is connected to the shaft of the type wheel, until the desired type faces the paper on the platen.

Referring again to FIG. 2 and FIG. 9, when the upper type wheel element 3*a* is to be selected, i.e. the desired type is on the upper type wheel element 3*a*, the electro-magnet 47 is not excited and the shaft 2 is at the lower position or in the "shift-in" condition. At this time the types on the upper type wheel element 3*a* are arranged at the position corresponding to the printing line on the paper. In this case the upper lever 22 abuts against the stopper 24 so that the upper pusher 16 will be operated, as mentioned before referring to FIG. 4.

When the lower type wheel element 3*b* is to be selected, i.e. the desired type is on the lower type wheel element 3*b*, the electro-magnet 47 is excited and the shaft 2 is forced to move to the upper position or to the "shift-out" condition. In this case the lower lever 25 abuts against the stopper 27 so that the lower pusher 17 will be operated, as mentioned before.

Figure 13:
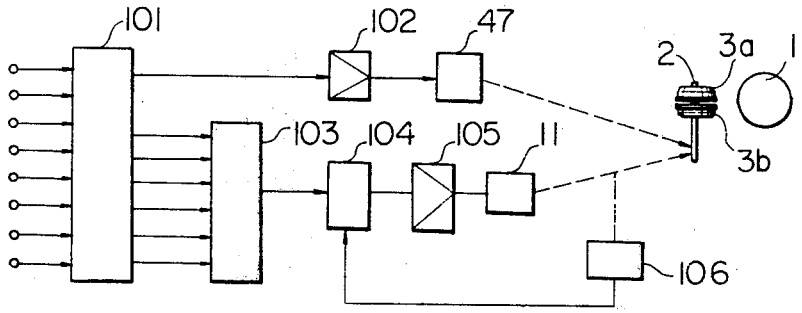
FIG. 13 is a schematic block diagram illustrating the type selecting means.

FIG. 13 is a block diagram for showing an embodiment of a servo system employable for selecting a desired type from types on the type wheel of a serial printer of the present invention. It should be noted that in FIG. 13, the same elements as those shown in other drawings are designated by the same reference numerals. In the servo system of FIG. 13, a data converting circuit 101 is provided with eight input terminals each of which receive an input consisting of eight bits. One of the eight bits is a command information for determing whether the type wheel 3 should be positioned at either its shift-in position or shift-out position, and six other bits express a command as to which type character on the type wheel 3 should be selected and positioned at the printing position of the type wheel 3 adjacent to the platen 1. The remaining one bit is used as a parity check bit. Thus, when the above-mentioned input is applied to the data converting circuit 101, the circuit 101, issues a shift-in signal or a shift-out signal and also a type character selection signal from its output terminals. The shift-in or shift-out signal is sent, through a servo amplifier 102, to the electro-magnet 47, the operation of which was previously explained. However, it should be noted that the electro-magnet 47 is excited only when the shift-out signal is applied to the electro-magnet 47. That is to say, application of the shift-in signal to the electro-magnet 47 does not cause excitation of the electro-magnet 47. Thus, when the shift-out signal excits the electro-magnet 47, it operates so as to lift the type wheel 3, which is normally at its lower position where the upper type wheel 3*a* is positioned adjacent to the platen 1. As a result of the lifting of the type wheel 3, the lower type wheel 3*b* comes adjacent to the platen 1 and is maintained there until the printing operation is completed. When the shift-in signal is applied to the electro-magnet 47, the electro-magnet 47 is not excited and, therefore, lifting of the type wheel 3 does not occur and the upper type wheel element 3*a* is positioned adjacent to the platen 1. The type character selection signal of six bits which is issued from the data converting circuit 101, is sent to a digital to analogue converter 103 in which the signal is converted into an anologue voltage signal. It should be noted that, since the signal of six bits can be indicative of one of 64 different pieces of information, the analogue voltage signal can correspondingly be one of 64 different voltage signals. The analogue voltage signal issued from the digital to analogue converter 103 is supplied to a comparing circuit 104. In the circuit 104 the signal is compared with a voltage signal which is sent from a potentiometer 106 to the comparing circuit 104 and which is indicative of the actual position of the type character wheel 3. The term "actual position" of the type character wheel 3 is used here to mean the position where the type wheel 3 was positoned to perform the immediately previous printing operation. The comparing circuit 104 produces a voltage signal corresponding to or proportional to the difference between the signal from the digital to analogue converter 103 and the signal from the potentiometer 106. The voltage signal produced by the circuit 104 is subsequently amplified by a DC amplifier 105 and supplied to the DC servo motor 11 which rotates the shaft 2 of the type character wheel 3. It should be noted that the rotation of the shaft 2 is continued until the difference between the signal from D-A converter 103 and the signal from the potentiometer becomes nil. Thus, when the rotation of the shaft 2 is stopped, the type character wheel 3 reach a state where a desired type character commanded by the input to the data converting circuit 101 is positioned at the printing position of the type character wheel 3.

The printing action is accomplished by the selected type striking the platen on which a ribbon and a paper is set. As mentioned before, with reference to FIG. 2, when the rotatable electro-magnet 33 is excited, the shaft 2 is forced to move or swing about the axis 32. At that time, naturally, the flexible joint 9 is bent or expanded.

When the type wheel is in the "shift-out" condition and is forced to move toward the paper by the operation of the rotatable electro-magnet 33, the lever 25 of the lower lever plate 15 abuts against the stopper 27. As the shaft 2 moves further, the lever plate 15 rotates about it with the result that the cam 26 forces the pusher 17 to project outwardly so that the selected type is pushed further outward than the adjacent types. At this time, the lever 22 of the upper lever plate 14 is located over the stopper 24 and is not in contact with it, so that the upper lever plate 14 does not rotate about the shaft 2 and the cam 23 does not force the pusher 16 to project.

Then, the pushed out type strikes the platen 1 on which a ribbon and a paper is set. Thus, the desired letter or character is printed on the paper.

The rotatable electro-magnet 33 is turned off just before the type strikes the platen, so that the type wheel 3 strikes the platen 1 by the force of inertia. After the type wheel 3 strikes the platen 1, it is forced to move away from the platen 1 and return to the original standing position by the resiliency of flexible joint 9 and the force of the spring 37.

When the type wheel is in the "shift-in" condition and is forced to move toward the platen by the operation of the rotatable electro-magnet 33, the lever 22 of the upper lever plate 14 abuts against the stopper 24. As the type wheel moves further, the upper lever plate 14 rotates about the shaft 2 with the result that the cam 23 forces the pusher 16 to project so that the selected type is pushed further outward than the adjacent types as shown in FIG. 11. At that time the lever 25 of the lower lever plate 15 is in the recess of the stopper 27 and doesn't abut against it, so that the lower lever plate 15 does not rotate and the cam 26 does not force the pusher 17 to project. Then, the pushed out type strikes the platen and returns to the original standing position in the same way as mentioned before.

Figure 12:
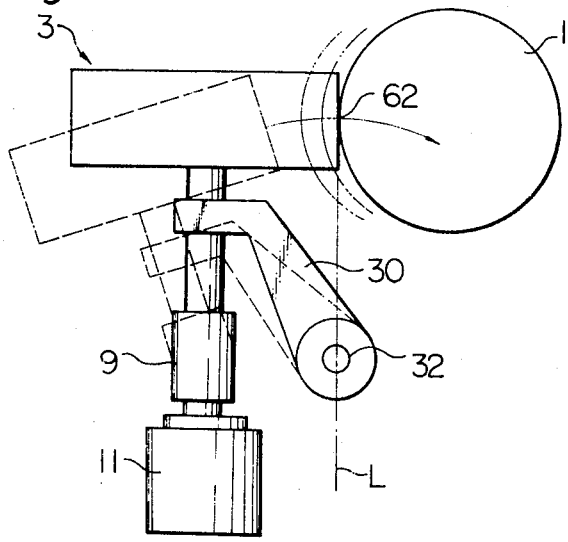
FIG. 12 shows a means for supporting a printer head according to the present invention.

Referring to FIG. 12, the location of the axis 32 will be described. It is important that the center of the axis 32 be located directly under the printing point 62 on the platen 1, i.e. on the tangential line L at the printing point 62. In such an arrangement, the type wheel 3 always strikes the platen 1 perpendicular to the said line L and, thus, the letter is fully printed without light or shaded areas. This advantage will be substantially maintained even if the thickness of the paper changes, so that letters are always evenly printed.

As the distance between the printing point 62 and the center of the axis 32 is different than the distance between the printing point 62 and the center of the flexible joint 9, said joint 9 must be capable of expanding and contracting. In this regard, a bellows may be used instead of the above mentioned flexible joint 9 and the serration mechanism.

As many seemingly widely different embodiments of this invention may be made without departing from the spirit and scope thereof, it is to be understood that the invention is not limited to the above described specific embodiment thereof except as defined in the appended claims.

What is claimed is:

1. A serial printer comprising:

a printer body;

a platen connected to said printer body;

a carriage mounted on said printer body for movement with respect to said platen;

a printer head mounted on said carriage including a shaft, and a type wheel being connected to said shaft and having a plurality of types, individually and resiliently supported thereon outward with respect to said printer head shaft;

said type wheel including a pair of type wheel elements each of which is formed with a boss having a central bore for mounting said type wheel element on said printer head shaft, a disk base spreading radially from said boss, a plurality of resilient arms each of which has one end fixed to said disk base and a type mounted on the outside of the radially outward end of each arm;

means for selecting a desired type from said plurality of resiliently supported types on said type wheel by moving said desired type to a printing position on said printer head wherein said selecting means includes a rotatable output shaft;

means for joining said printer head shaft and said output shaft of said type selecting means;

means for pushing said selected type further outward, toward said platen, than adjacent types;

means for supporting said printer head on said carriage to pivotally move about a first axis to strike said platen, and;

striking means connected to said printer head for pivoting said printer head about said first axis to strike said platen, and for printing said selected type.

2. A serial printer according to claim 1, wherein said printer head shaft is arranged substantially vertical and said pair of type wheel elements are mounted thereon so that one type wheel element is elevated with respect to the other.

3. A serial printer according to claim 1 wherein each of said arms has a part adjacent to said outward end and extending parallel to said printer head shaft.

4. A serial printer according to claim 1 wherein said arms are made of resilient material.

5. A serial printer according to claim 1, wherein said selecting means comprises a means for shifting said printer head in the axial direction of said printer head shaft so that one of the type wheel elements is selected and a means for rotating said printer head until the desired type on said selected type wheel element faces the platen at said printing position.

6. A serial printer according to claim 5, wherein said means for shifting said printer head comprises a pivotally movable shifting lever having a link which is integral with said shifting lever and a pin contacting said printer head shaft, said shifting means also includes a filament, one end being connected to said shifting lever and the other end being connected to said carriage, a pulley for carrying a portion of said filament, a pivotally movable lever rotationally supporting said pulley, and an electro-magnet means for attracting said movable lever causing the movement of said pulley and said filament, thereby pivoting said shifting lever and said link with the result that said pin forces said printer head shaft to move axially.

7. A serial printer according to claim 5, wherein the means for rotating said printer head comprises an electric motor.

8. A serial printer comprising:

a printer body;

a platen connected to said printer body;

a carriage mounted on said printer body for movement with respect to said platen, said carriage including at least one stopper element;

a printer head mounted on said carriage including a shaft and a type wheel being connected to said shaft and having a plurality of types, individually and resiliently supported thereon outward with respect to said printer head shaft;

means for selecting a desired type from said plurality of resiliently supported types on said type wheel by moving said desired type to a printing position on said printer head, wherein said selecting means includes a rotatable output shaft;

means for joining said printer head shaft and said output shaft of said type selecting means;

means for pushing said selected type further outward, toward said platen, than adjacent types, said type pushing means including at least one lever plate rotatably connected to said printer head shaft and having an actuating lever adjacent said stopper element for rotating said lever plate about said print head shaft when said printer head moves toward said platen;

means for supporting said printer head on said carriage to pivotally move about a first axis to strike said platen, and;

striking means connected to said printer head for pivoting said printer head about said first axis to strike said platen, and for printing of said desired type.

9. A serial printer according to claim 8 wherein said type pushing means also includes a pusher between said at least one lever plate and said desired type on said type wheel, said lever plate actuating said pusher to force said desired type to project further outward than said adjacent types by rotating about said printer head shaft.

10. A serial printer according to claim 9 wherein each said at least one lever plate has a cam on its end to actuate said pusher.

11. A serial printer comprising:

a printer body;

a cylindrical platen horizontally mounted on said printer body;

a carriage mounted on said printer body for movement with respect to said platen;

a printer head, including a substantially vertical shaft and a pair of type wheel elements, connected to said vertical shaft, each said type wheel element including a plurality of resiliently supported types thereon;

a means for selecting a desired type from said plurality of resiliently supported types and for moving said desired type to a printing position on said printer head, wherein said selecting means includes a rotatable output shaft;

means for joining said vertical shaft and said output shaft of said type selecting means;

means for pushing said selected type further outward, toward said platen, than adjacent types, said pushing means comprising an upper lever plate and a lower lever plate rotatably connected to said vertical shaft, an upper pusher and a lower pusher arranged between and for engagement with corresponding upper and lower lever plates and said desired type on said type wheel element, one of said lever plates actuating said corresponding pusher to force said desired type to project further outward than said adjacent types by rotating about said vertical shaft;

means for supporting said printer head on said carriage and for allowing said printer head to pivotally move about an axis to strike said platen at a predetermined printing point, and;

a striking means connected to said printer head for causing said printer head to strike said platen thereby enabling printing of said desired type.

12. A serial printer according to claim 11 wherein each of said type wheel elements is formed with a boss having a central bore for mounting said type wheel element on said vertical shaft, a disk base spreading radially from said boss, and a plurality of arms, each of said plurality of arms having one end fixed to said disk base and a portion adjacent to the other end extending parallel to said vertical shaft with a type molded on the outside thereof, one of said type wheel elements being elevated with respect to the other type wheel element.

13. A serial printer according to claim 12 wherein said arms are made of resilient material.

14. A serial printer according to claim 11 wherein said selecting means comprises a means for shifting the printer head vertically so that one of said type wheel elements is selected for printing and a means for rotating said printer head until said desired type on said selected type wheel element faces said platen at said printing position.

15. A serial printer according to claim 14 wherein said shifting means comprises a pivotally movable shifting lever, a link which is integral with said lever and has a pin in contact with an abutment on said vertical shaft, a filament having one end connected to said shifting lever and another end connected to said carriage, a pulley cooperating with said filament, a pivotally movable lever to which said pulley and an armature are connected, and an electro-magnet for attracting said armature to cause the movement of said lever, said pulley and said filament, thereby rotating said shifting lever and said link with the result that said pin forces said vertical shaft to move in a vertical direction.

16. A serial printer according to claim 14 wherein said means for rotating the printer head comprises an electric motor.

17. A serial printer according to claim 11 wherein said joining means coaxially connects said vertical shaft with said output shaft of the type selecting means.

18. A serial printer according to claim 11 wherein said joining means has a flexible member intermediate two joined ends on the opposite ends of said flexible member, whereby one joined end being connected to said printer head and the other joined end being connected to said output shaft of said type selecting means.

19. A serial printer according to claim 11 wherein each of said lever plates has a cam surface for actuating said corresponding pusher.

20. A serial printer according to claim 19 wherein said carriage includes a stopper means for actuating said lever plates, and each of said lever plates has a lever which can abut against said stopper means when said printer head moves toward the platen, thereby rotating said lever plate about said vertical shaft and causing said cam to actuate said corresponding pusher.

21. A serial printer according to claim 11 wherein said support means allows said printer head to pivotally move about said axis located on a tangential line which contacts said platen at said predetermined printing point.

22. A serial printer according to claim 11 wherein said striking means comprises an electro-magnet mounted on said carriage, an output lever fixed to said output shaft of said electro-magnet and a link connected to said output lever for transmitting the striking force from said electro-magnet to said printer head.

* * * * *

UNITED STATES PATENT AND TRADEMARK OFFICE

CERTIFICATE OF CORRECTION

PATENT NO. : 3,990,562

DATED : November 9, 1976

INVENTOR(S) : HAJIME GOTO et al

It is certified that error appears in the above-identified patent and that said Letters Patent are hereby corrected as shown below:

Column 3, line 62, before "servo" insert --DC--.

Column 5, line 7, "3" should be --E--.

Signed and Sealed this

Eighth Day of February 1977

[SEAL]

*Attest:*

RUTH C. MASON
*Attesting Officer*

C. MARSHALL DANN
*Commissioner of Patents and Trademarks*